US006507281B2

(12) United States Patent
Mägerle et al.

(10) Patent No.: US 6,507,281 B2
(45) Date of Patent: Jan. 14, 2003

(54) METHOD AND DEVICE FOR CONFIGURING A TUNNEL FIRE DETECTION SYSTEM

(75) Inventors: Rudolf Mägerle, Männedorf (CH); Robert Notz, Männedorf (CH); Bruno Covelli, Suhr (CH)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/773,991

(22) Filed: Feb. 1, 2001

(65) Prior Publication Data

US 2001/0038334 A1 Nov. 8, 2001

(30) Foreign Application Priority Data

Feb. 3, 2000 (EP) ..... 00102318

(51) Int. Cl.[7] ..... G08B 17/00

(52) U.S. Cl. ..... 340/584; 340/286.05; 340/525; 340/588

(58) Field of Search ..... 340/584, 588, 340/942, 589, 506, 511, 525, 331, 332, 286.05, 691.6; 700/12, 17, 83; 702/130, 188

(56) References Cited

U.S. PATENT DOCUMENTS 4,149,159 A * 4/1979 Datwyler et al. ..... 340/522
4,287,515 A * 9/1981 Raber et al. ..... 340/584
4,991,657 A * 2/1991 LeLande, Jr. ..... 169/46
5,165,482 A * 11/1992 Smagac et al. ..... 169/13
5,557,262 A * 9/1996 Tice ..... 340/522
5,574,434 A * 11/1996 Liu ..... 340/534
5,734,335 A * 3/1998 Brogi et al. ..... 340/577
5,752,215 A * 5/1998 Zaaiman et al. ..... 701/117
5,832,187 A * 11/1998 Pedersen et al. ..... 395/50

FOREIGN PATENT DOCUMENTS

JP 10-88997 * 7/1998

* cited by examiner

*Primary Examiner*—Daniel J. Wu
*Assistant Examiner*—Son Tang
(74) *Attorney, Agent, or Firm*—Baker Botts LLP

(57) ABSTRACT

A system and method are provided for configuring a tunnel fire detection system including a linear heat sensor. The fire detection system is configured based on a plurality of tunnel parameters describing the tunnel, a plurality of sensor parameters describing the linear heat sensor, and a plurality of partial fire models describing aspects of fire development. The system and method calculates fire development based on the plurality of tunnel parameters, the plurality of sensor parameters, and the plurality of partial fire models. The system and method can set the fire alarm time, the installation point of the sensor cable and the alarm limit values of the detection system such that a potential fire is quickly and reliably detected.

18 Claims, 4 Drawing Sheets

10

100

300

METHOD AND DEVICE FOR CONFIGURING A TUNNEL FIRE DETECTION SYSTEM

SPECIFICATION

1. Field of the Invention

The present invention relates generally to fire detection and more specifically to fire detection in tunnels using a linear heat sensor.

2. Background of the Invention

Fire detection systems are required to detect fires in a multitude of places. Fire detection systems have been developed for use in the home, in office buildings, and in tunnels. One such tunnel fire detection system is sold under the name "FibroLaser" by Siemens Building Technologies AG, Cerberus Division, formerly Cerberus AG (hereinafter "the FibroLaser System"). The FibroLaser System includes a glass-fiber cable, a laser light source, a wave guide, and an optoelectronic receiver. The glass-fiber cable is made of silica glass and should be installed along a tunnel roof. The laser is placed in registration with one end of the glass-fiber cable and the wave guide is placed in registration with the other end of the glass-fiber cable. Light generated by the laser is conveyed in a longitudinal direction along the glass-fiber cable. Variations in the density of the silica glass caused by heat give rise to a continuous scattering of the laser light being transmitted therein, otherwise known as Rayleigh scattering, which in turn gives rise to attenuation of the laser light. In addition, thermal lattice vibrations of the silica glass lead to further light scattering known as Raman scattering.

The scattered light propagates along the glass-fiber cable and enters the wave guide. A fraction of the scattered light falls into an acceptance angle of the wave guide which causes it to scatter both in a forward and backward direction. Some of the scattered light is detected by the optoelectronic receiver. The optoelectric receiver evaluates the intensity of specific backscatter frequencies, which allows the optoelectric receiver to determine the local glass-fiber temperature. The local resolution of the temperature profile along the glass-fiber cable is determined by measuring the subduing of the wave guide light. The magnitude of the fire is a function of the heated cable length: a short heated length corresponds to a small fire and a long heated length corresponds to a large fire. An alarm can be set which is triggered by the magnitude of the fire.

Because of the complex thermodynamic processes which occur during a fire, it is virtually impossible for all of the influencing quantities which occur during the fire to be fully taken into account. Therefore, configuring a detection system including a linear heat sensor is extremely laborious and time-consuming and entails numerous practical trials. Clearly, there exists the need to simplify this process.

OBJECTS AND SUMMARY OF THE INVENTION

The present invention relates to a method of configuring a tunnel fire detection system comprising a linear heat sensor. The method according to the invention is to enable tunnel fire detection systems to be individually adjustable as early as during the planning stage in a highly flexible manner subject to the physical and local conditions of a tunnel.

The stated object is achieved according to the invention on the basis of parameters of the tunnel and sensor cable as well as on the basis of fire models the fire development can be determined. And based on this fire development, fire alarm times, installation points for the sensor cable, and alarm limit values of the detection system can be calculated and optimized in such a way that a potential fire is quickly and reliably detected.

In a preferred embodiment the system for configuring a tunnel fire detection system comprising a linear heat sensor includes a storage device, a plurality of parameters, a plurality of partial fire models, an input device, a processing unit and an output device. The storage device stores the plurality of parameters and the plurality of partial fire models. The plurality of parameters include a plurality of tunnel parameters describing the tunnel, and a plurality of sensor parameters describing the linear heat sensor. The plurality of partial fire models describing aspects of fire development. The input device allows for entering the data and parameters into the system. The processing unit calculates the fire development and the resultant heating of the sensor cable on the basis of the plurality of parameters and the plurality of partial fire models. The display device outputs the alarm limit values and fire alarm times, which are obtained based upon the plurality of parameters and the plurality of partial fire models.

BRIEF DESCRIPTION OF THE DRAWINGS

Further objects, features and advantages of the invention will become apparent from the following detailed description taken in conjunction with the accompanying figures showing illustrative embodiments of the invention, in which.

Figure 1:
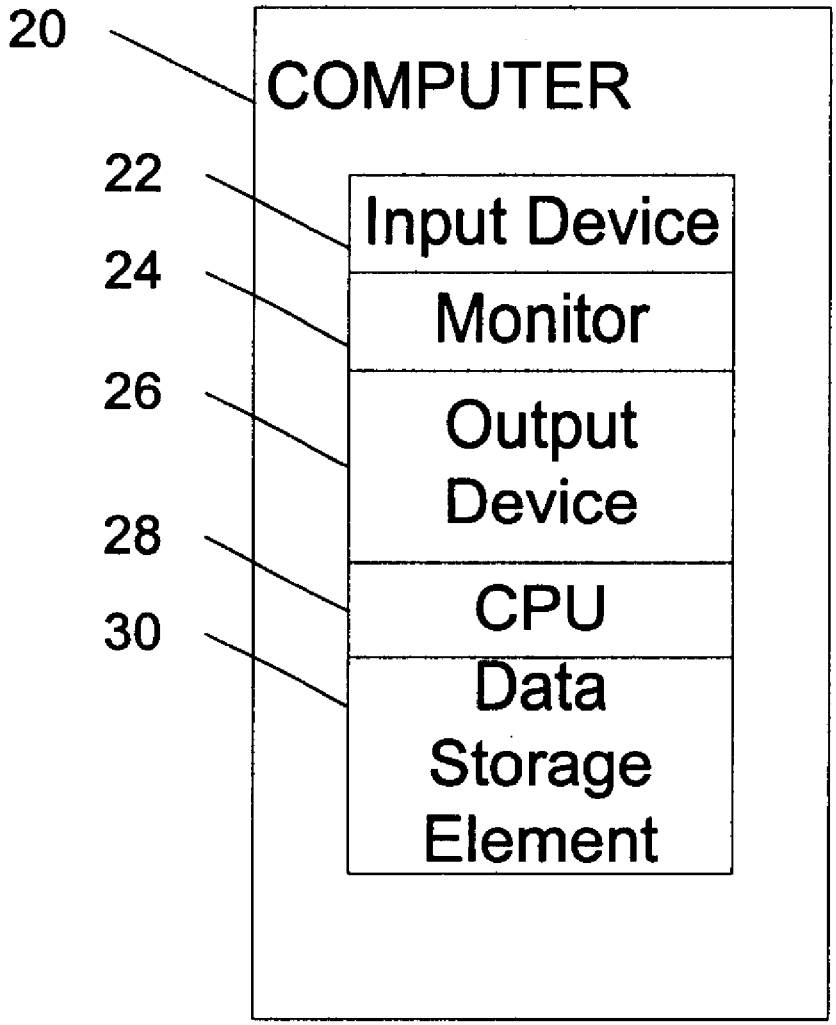
FIG. 1 is a simplified block diagram illustrating the present system.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION OF PREFERRED EMBODIMENTS

The invention is herein described with respect to fire detection in a tunnel, but it will be recognized that the system and method can be likewise arranged for other fire detection scenarios. The invention herein described can be embodied in a computer program which can be stored on a hard drive, a CD-ROM disk, a removable floppy disk, a zip drive or the like.

In order to improve the reliability and speed of fire detection, it is desirable to take into account the bum-up behavior, the magnitude of the fire, the wind conditions, the tunnel geometry, the spatial arrangement of the sensors and the location of the fire. In many cases use is made of a detection system with a linear heat sensor for fire detection in tunnels, such as the FibroLaser system wherein, a silica-glass cable is utilized as a linear sensor. The silica-glass cable, hereinafter the sensor cable, includes a silica-glass core coated with heat transfer compound, for example, a steel capillary tube, which surrounds the silica-glass core having a diameter of e.g., 1.6 mm, and a polyethylene outer sheath may be included having a diameter of approximately 8 mm. The sensor cable may be heated both by combustion gases flowing around it, i.e., convective heat exchange, and by radiation. Both types of heat flow may occur separately or simultaneously. By using the simulation system, the application engineer can simulate the conditions under which the sensor cable will be placed, which have been verified by bench scale and large scale tests, and tune the system parameters to highly accurate alarm settings.

FIG. 1 shows the system 10 according to the present invention. The system 10 includes a computer 20, which includes an input device 22, a monitor 24, an output device 26, a central processing unit 28, and a data storage element 30. The computer 20 can take on many different forms, preferably a laptop computer. The central processing unit 28 performs the calculations necessary for the simulation to perform its intended function. The monitor 24 allows a user to view output from the system and system messages that require the user's attention. The input device 22, i.e. a keyboard, PDA, or network connection, allows the user to input necessary data to the system. The output device 26, i.e. a printer or network connection, allows the system to output the results of the simulation when the simulation is complete. And the data storage unit 30, i.e. hard drive, zip drive, disk drive, or CDR drive, allows the system to store system data.

The simulation system is provided with a set of models which have been developed to model different aspects of a fire. The models are based on thermodynamic modeling of the combustion processes, wherein the thermodynamic models observe the conservation quantities of physics, including conservation of mass, conservation of energy, and conservation of momentum, and require only a few empirical values. The following models are provided to the system: reaction enthalpy, energy and mass balance, length of the reaction zone, energy balance in the plume, flow mechanics of the plume, wind in tunnel, fire development, and heat exchange. The reaction enthalpy model allows the system to calculate the reaction enthalpy. This model is based on analysis of the ultimate state of incendiary materials. The energy and mass balance models observe the conservation and balance of these quantities in the reaction zone. The length of the reaction zone is a model which extrapolates the length of the reaction zone. The energy balance in the plume models the energy balance in the cooling down zone above the reaction zone, otherwise known as the plume. The model of flow mechanics in the plume allows the system to predict the flow mechanics in the plume based on a free jet model. The wind in tunnel model models the influence of the wind in the tunnel upon the reaction zone and the plume. The fire development model allows the system to predict the manner in which the fire will develop. The heat exchange model models the heat exchange by virtue of radiation and convection as well as heat conduction in the glass-silica cable.

Figure 2:
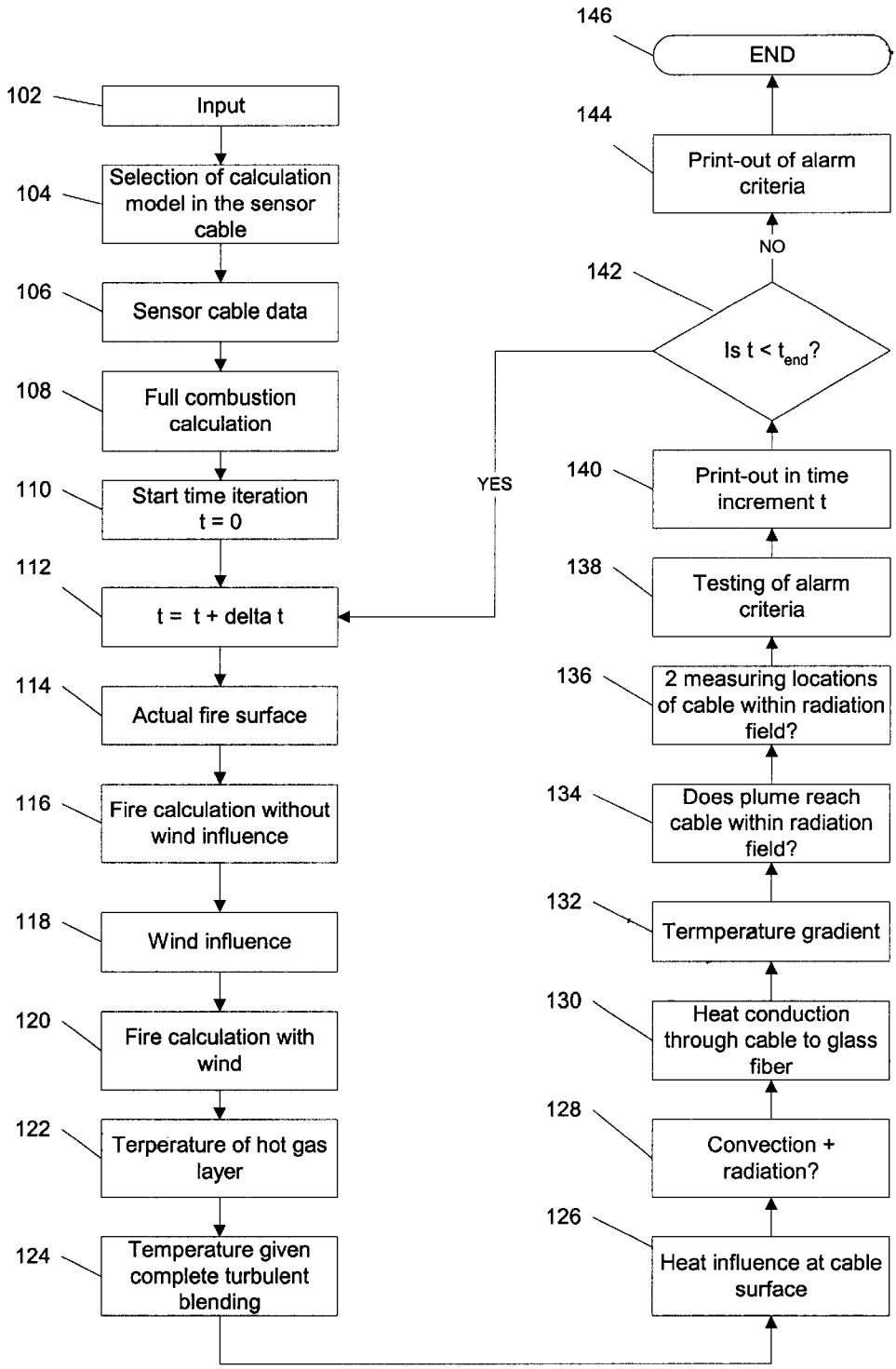
FIG. 2 is a simplified flow chart of the main program for calculating fire alarm times of a tunnel fire detection system including a heat sensor.

FIG. 2 shows a flow chart 100 of a main program executed by the system for calculating the fire alarm times of the tunnel fire detection system according to the invention. The main program is begun when the system executes a process block 102. The process block 102 accepts various input parameters describing a tunnel a sensor cable, and a fire. The simulation model receives the following input parameters: fire diameter, tunnel height, tunnel width, distance between sensor and ground, distance between sensor and fire, wind velocity, wind in the region of the sensor cable, tunnel pressure, sensor diameter, tunnel temperature, alarm temperature, gradient of the alarm temperature, and fire acceleration rate.

The following are input parameter definitions. Fire diameter describes a diameter of a circle equal in area to the total surface of the combustible. Tunnel height is the distance between the carriageway and the height of the tunnel. In the case of a tunnel with an arched roof, a mean roof height in the arch region is generally accepted, but the tunnel height must place the roof above the sensor cable. Tunnel width is the shortest distance between the tunnel walls at the mid-height point of the tunnel. Distance between sensor and ground is defined as the shortest distance between sensor cable and carriageway. This parameter should be smaller than the tunnel height in most cases. Distance between sensor and fire describes the shortest distance between the center of the fire surface and the sensor cable. Wind velocity corresponds to the air speed along the carriageway taken as a mean over the tunnel cross section. If there is a strong transverse air flow which is greater than the wind velocity along the carriageway, the velocity of the transverse air flow is used. Wind in the region of the sensor cable describes the wind velocity along the sensor cable. The wind in a tunnel presents a profile which generally tends towards zero at the walls and at the roof. If there is wind along the sensor cable, the effect should be taken into account. Tunnel pressure describes the ambient pressure in the fire region. Generally, this depends on the height above sea level. Tunnel temperature is defined as the ambient temperature in the fire region. This temperature influences the tripping of the alarm temperature in the detection system. Sensor diameter is the outside diameter of the sensor cable. Alarm temperature is the temperature threshold value, at which or above which the detection system is to indicate a fire alarm. This value is generally in the region of 50° to 80° C. Alarm temperatures below 50° C. may trigger false alarms in the entrance and exit regions of the tunnel. Gradient of the alarm temperature describes the increase of temperature over time, and is used to determine the gradient which forms the threshold value for triggering a fire alarm. Should the temperature rise per second faster than the threshold value, an alarm is triggered. Preferably, the threshold value is set to 0.1° C./sec. or 6° C. per minute. Fire acceleration rate is defined as the rate of growth of the fire given an unlimited supply of air to the seat of the fire. This increases linearly with time. For the bum-up capacity $Q^*$ of a fire having the fire surface A at time t, $Q^*=A^*B^*t^2$ applies, in which the so-called fire acceleration rate B is a measure of the fire development up to full combustion. For B there are empirical values, which are stored in a table.

Whenever possible, the aforementioned parameters are based on a worst-case scenario. For example, the distance between sensor and fire is set at a maximum foreseeable value. After the system records the requisite parameters, the parameter sets of the fire model are stored in the system, and the process block 104 is executed.

Executing process block 104 causes the system to choose a calculation model in the sensor cable. Two different calculation models may be used: the homogeneous model and the differential model. The models differ in accuracy and in computing speed. In the case of the homogeneous model, the temperature profile through the outer sheath is disregarded and it is assumed that the entire cable is heated to a mean temperature. In the case of the differential model, which takes far more computing time, precise calculation of the heating of the glass fiber in the sensor cable is effected by solving the non-steady heat conduction quadratic equation. The non-steady heat conduction quadratic equation has to be extended as a simultaneous differential equation system because the sensor cable has various layers. The differential model is described in more detail in FIG. 4. After a calculation method is selected, the system executes process block 106.

Executing process block 106 causes the system to wait for input about the sensor cable. The user of the system must input data describing the sensor cable. After the data is input, the system executes process block 108.

Executing process block 108 causes the system to perform the full combustion calculation without wind influence. This process is shown in more detail in FIG. 3. The full combustion calculation supplies the temperature in the reaction zone (flame zone) and in the plume, i.e. the two quantities responsible for heating the sensor cable. After the full combustion calculation is completed the system executes process block 110.

The system executes process block 110 and sets the start time iteration equal to 0. The time iteration is then started, wherein all thermodynamic states are calculated at time increments ($\Delta t$) of 1 second, thereby enabling precise mapping of the fire development. After the start time iteration is set, the system executes process block 112.

Executing process block 112 causes the system to add $\Delta t$ to the start time iteration. This increases the start time iteration for the next iteration. After the start time iteration is set, the system executes process block 114.

Executing process block 114 causes the system to wait for input. The system waits until the actual fire surface is entered. After the actual fire surface is entered, the system executes process block 116.

Executing process block 116 causes the system to calculate the fire development without wind influence. After the fire development without wind influence is calculated, the system executes process block 118.

Executing process block 118 causes the system to take input corresponding to wind influence and the distance between the fire surface and the detector cable. The input describes the wind influence upon the reaction zone and the plume, and the distance from the fire surface to the detector cable. After the data input is complete, the system executes process block 120.

Executing process block 120 causes the system to calculate the fire development taking into account the wind influence data. After the calculation takes place, the system executes process block 122.

Executing the process block 122 causes the system to determine the temperature of the hot gas layer. After the system computes the temperature of the hot gas layer, the system executes process block 124.

Executing the process block 124 causes the system to determine the temperature given complete turbulent blending. Using the temperature in the reaction zone, the temperature in the plume, the fire calculation with wind, and the calculation of the temperature of the turbulent hot gas layer, the temperatures given complete turbulent blending in the tunnel cross section are calculated. After the temperatures are calculated, the system executes process block 126.

Executing process block 126 causes the system to determine the heat influence at the cable surface. The heat flow into the cable surface, through convection and radiation, is determined. After the head flow is determined, the system executes process block 128.

Executing process block 128 causes the system to determine how convection and radiation are impacting the cable. The heat flow from convection and radiation is estimated, and whether convection heat and radiation are acting jointly upon the cable is determined. After the heat flow source is determined, the system executes process block 130.

Executing process block 130 causes the system to determine the amount of heat conduction through the sensor cable. The system calculates the amount of the heat conduction through the sensor cable to the glass fiber according to the differential model shown in FIG. 4. After the amount of heat conduction is calculated, the system executes process block 130.

Executing process block 132 causes the system to determine the temperature gradient. The system uses the temperature profile in the cable to form the temperature gradient. After the temperature gradient is computed, the system executes process block 134.

Executing process block 134 causes the system to determine whether the plume reached the cable within the radiation field. The system checks whether, during the simulation, the plume reaches the cable within the radiation field. If the plume reaches the cable there is superimposition of convection and radiation. After this is determined, the system executes process block 136.

Executing process block 136 causes the system to test two measuring locations along the field. The system searches to see if there were two measuring locations of the cable situated within the radiation field. If not, there is damping of the radiation surface temperature. After the system determines whether there was damping of the radiation surface temperature, the system executes process block 138.

Executing process block 138 causes the system to test the alarm criteria. After the system tests the alarm criteria, the system executes process block 140.

Executing process block 140 causes the system to print out the fire alarm time. The system prints the fire alarm time in the time increment t. After the system prints the fire alarm time, the system executes decision block 142.

Executing decision block 142 causes the system to compare the time increment t to $t_{END}$. If t is less than $t_{END}$, the system executes process block 112. If t is greater than or equal to $t_{END}$, the system executes process block 144.

Executing process block 144 causes the system to print out the alarm criteria. The alarm criteria inform the user whether the desired fire alarm time may be achieved with the entered parameters or whether all or some of the parameters need to be altered. After this information is printed, the system is done, and the process exits.

Figure 3:
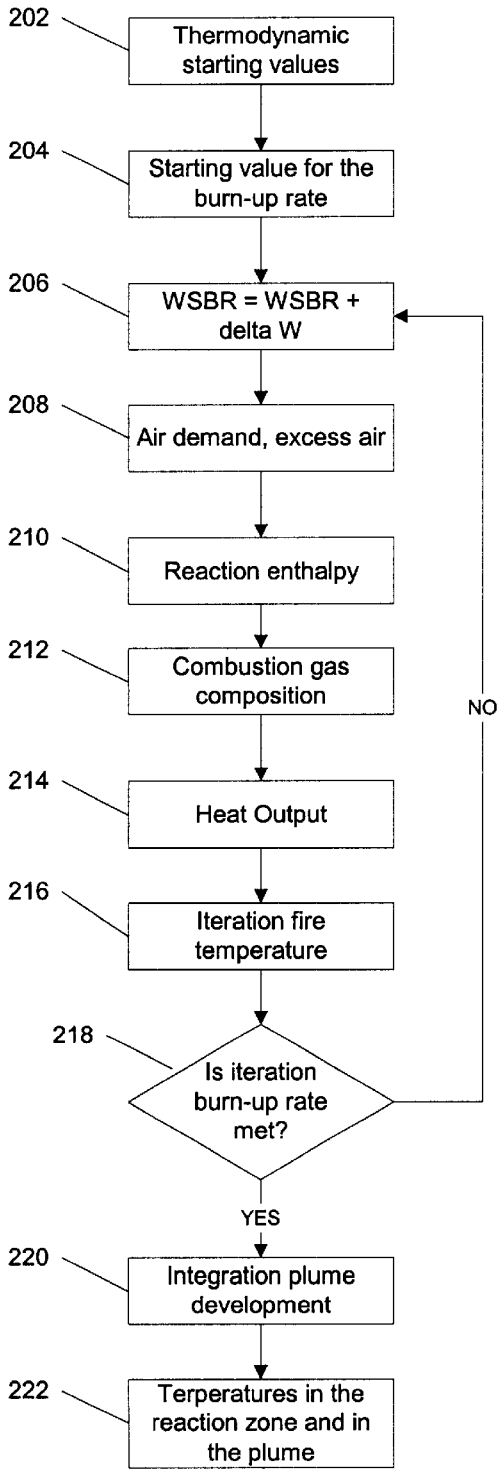
FIG. 3 is a simplified flow chart of the subroutine for calculating fire development.

FIG. 3 is a flow chart 200 which describes the full combustion calculation. The system begins the full combustion calculation by executing process block 202. Executing process block 202 causes the system to take input describing the thermodynamic starting values. After the thermodynamic starting values are entered, the system executes process block 204.

Executing process block 204 causes the system to take input describing the starting values for the burn-up rate (BUR). The bum-up rate is defined as the fire development up to full combustion. After the input is gathered, the system executes process block 206.

Executing process block 206 causes the system to increase BUR by $\Delta W$. This causes BUR to increase slowly, by increments of ΔW, until the iteration bum-up rate is met. After the system increases BUR, the system executes process block 208.

Executing process block 208 causes the system to calculate the excess air. In a fire, substances in the incendiary material are oxidized by the atmospheric oxygen in the reaction zone, wherein the thermal energy released by such oxidation reactions heats the gases in the reaction zone. With most fires, the elements carbon, hydrogen and sulfur oxidize. Any halogens contained in the incendiary material preferably react with the hydrogen during oxidization. For the simulation, the halogen content, as well as the rare-earth elements content is assumed to be negligible.

In the reaction zone there is a build-up of above all $CO_2$, $H_2O$ and $SO_2$, wherein specific heat quantities per mole are liberated. Given an oxygen deficiency there is an increased build-up of CO and at the same time the water-gas reaction plays an important part, wherein said energy-consuming reduction is dependent upon the supply of educts and upon the temperature in the reaction zone. From the known reaction scheme the oxygen demand for ideal, full combustion may be determined stoichiometrically and from the latter, the fire mass and the mass fraction of the inlet air the stoichiometric air mass.

In the case of a fire with natural convection, in the reaction zone more air is converted than the stoichiometry of the combustion reactions demands. This extra air being the excess air number. The excess air number may be calculated from the so-called $k_B$ factor, which is used to determine the minimum oxygen fraction from the guidelines for inert-gas fire extinguishing plant. The minimum oxygen fraction is the oxygen concentration which is required to maintain the combustion reactions and which may lie above the stoichiometric air demand. After the excess air number is calculated, the system executes process block 210.

In process block 210 the system computes the reaction enthalpy. In the case of incomplete combustion, at the cost of $CO_2$, there is an increased build-up of CO and free hydrogen. If incomplete combustion occurs the oxygen demand is greater than the reaction zone inlet may supply. From the mass fractions of carbon, hydrogen, sulfur and oxygen in the incendiary material and from the mass fraction of the inlet air it is possible to determine the fraction of $CO_2$ in the combustion gas and from the latter the other reaction products and the reaction enthalpies. After the reaction enthalpy is computed, the system executes process block 212.

Executing process block 212 causes the system to determine the combustion gas composition. The system records the data determined during process block 210, and completes the determination of the combustion gas composition. After the combustion gas composition is determined and recorded, the system advances to process block 214.

In process block 214, the system determines the heat output. The liberated combustion heat or reaction enthalpy of the incendiary material may be stoichiometrically determined. Alternatively, the combustion enthalpies of most materials have been experimentally determined in the fire regulations (Sprinkler Guidelines, DIN 4201, DIN 18232, etc.) and may be obtained from appropriate tables. According to a preferred embodiment, the heat output in the reaction zone is calculated from the combustion gas composition. After the heat output is calculated, the program advances to process block 216.

Executing process block 216 causes the system to iterate the resultant temperature with the flame length and the enthalpy and mass balance. After the fire temperature is iterated, the system executes decision block 218.

Executing decision block 218 causes the system to determine if the iteration burn-up rate is met. From the gas volumetric flow and the gas velocity over the reaction zone the momentum balance in the region of the reaction zone is determined and an iteration of the burn-up rate according to the total mass balance is effected. If the burn-up rate meets the value corresponding to the desired fire duration process block 220 is executed. If the bum-up rate does not meet the desired value, process block 206 is executed.

Executing process block 220 causes the system to integrate the plume development. The plume development from the reaction zone up to the roof is included in the momentum, mass and enthalpy balance and the air admixture and wind correction are taken into account. After the integration of the plume development, the system executes process block 222.

Executing process block 222 causes the system to perform the final calculations which determine the temperatures in the reaction zone and in the plume. In the cooling-down zone above the reaction zone the hot combustion gases mix in a turbulent peripheral area with the ambient gas, e.g. air, with the result that the vertically upward streaming gas flow widens. For the simulation it is assumed that the behavior of the rising combustion gases corresponds to a turbulent free jet, with the reaction zone as the jet core. The temperature reduction as a function of height may be acquired by means of an energy balance over the vertical layer and the mean rate of ascent may be acquired by means of a momentum balance over the local plume cross section, so that finally the local speed reduction in the plume is obtained.

It is assumed that the plume opens like a turbulent free jet, of which the angle of spread is 8 degrees to 15 degrees. The angular dependence may be determined from the pressure difference between jet and environment. Wind velocities of up to 10 m/s give rise in the tunnel cross section to a turbulent longitudinal flow, the turbulence clusters of which are much smaller than the tunnel cross section. The air flow, despite the high Reynolds' number in the region of $10^6$ compared to the tunnel dimensions, may be described as laminar. From this point of view, the assumption is allowable that the flow of momentum of the wind is superimposed on the flow of momentum of the plume so that the gases in the plume are carried away by the wind without the plume being completely swirled. The influence of the wind lends the plume a specific angle of inclination, which may be determined from the ratio of the gas velocity in the plume to the wind velocity in the tunnel. After the system determines the temperature in the reaction zone and the temperature in the plume in the case of full combustion, the system exits process block 222.

Figure 4:
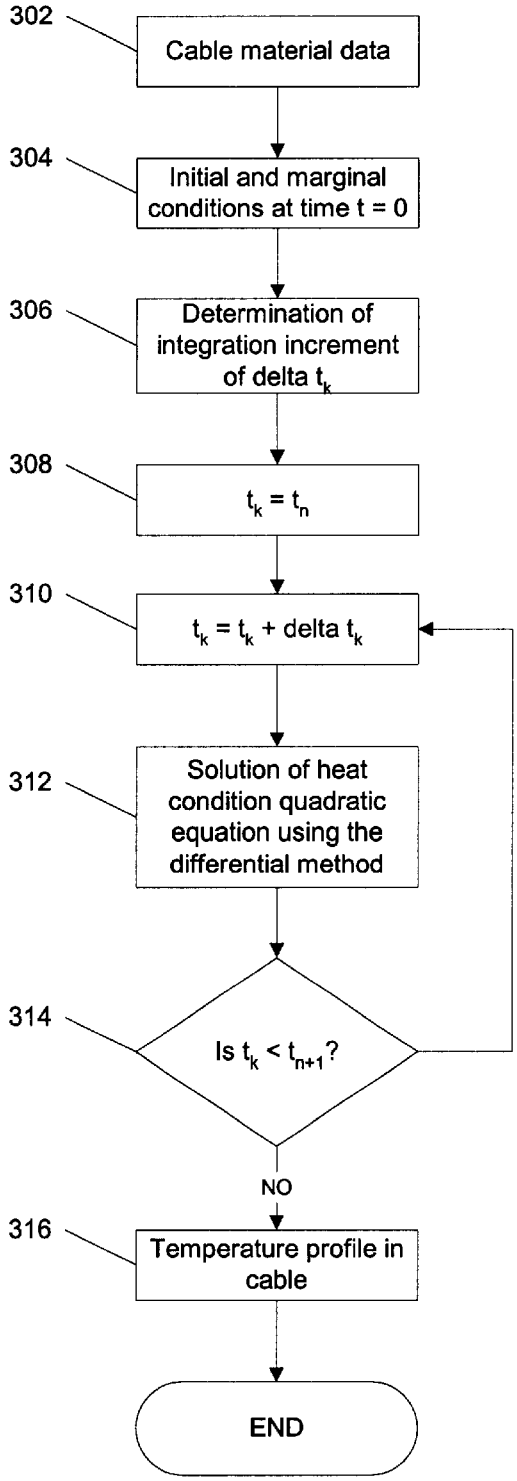
FIG. 4 is a simplified flow diagram of the subroutine for calculating the temperature in the sensor cable.

FIG. 4 depicts a flow chart 300 showing the differential heat conduction process by which the amount of the heat conduction through the sensor cable to the glass fiber is calculated according to the differential model. The differential heat conduction process is initiated when the system executes process block 302.

Executing process block 302 causes the system to take input relating to the cable. The system waits for the material data of the cable. After the material data of the cable is provided, the system executes process block 304.

Executing process block 304 causes the system to initialize certain variables. The initial conditions and marginal conditions at time t=0 are entered. After the conditions are set, the system executes process block 306.

In process block 306, the system sets the integration increment, $\Delta t_k$. The integration increment $\Delta t_k$ describes the amount of time between the heat conduction calculations. Preferably, the integration increment $\Delta t_k$ is set to approximately $10^{-3}$ seconds. After the integration increment $\Delta t_k$ is set, the system advances to process block 308.

In executing process block 308, the system initializes the time index, $t_k$, to a value equal to the start time for the calculation: $t_n$. After the time index $t_k$ is initialized, the system advances to process block 310.

Executing process block 310 causes the system to increment the time index. The time index $t_k$ is incremented by the integration increment $\Delta t_k$. After the time increment is incremented, the system advances to process block 312.

Executing process block 312 results in the calculation of the heat conduction temperature for that time increment. The heat conduction quadratic equation is solved using the differential method and is stored in the temperature profile as the temperature in the cable at that time. After the temperature is recorded, the system executes decision block 314.

According to decision block 314, the system compares the time index $t_k$ to the start time for the next iteration $t_{n+1}$. If the time index $t_k$ is less than the start time for the next iteration $t_{n+1}$, the system executes the process block 310. If the time index $t_k$ is greater than or equal to the start time for the next iteration $t_{n+1}$, the system executes the process block 316.

Executing process block 312 causes the system to save the temperature profile. The temperature profile, representing the temperature in the cable every $\Delta t_k$ seconds, is complete, and the differential heat conduction process ends.

The present systems and methods have been described in the context of certain preferred embodiments thereof. For the sake of clarity, the operation has generally been described in connection with fire detection in tunnels. However, it will be appreciated that the systems and methods discussed are generally applicable to fire detection systems. Further, other changes and modifications can be effected by those skilled in the art. It is intended that such changes are considered within the scope of the present invention as set forth in the appended claims.

What is claimed is:

1. A method of configuring a tunnel fire detection system having a linear heat sensor, comprising:

providing a plurality of tunnel parameters describing the tunnel;

providing a plurality of sensor parameters describing the linear heat sensor;

providing a fire model describing aspects of fire development;

calculating the fire development based on the plurality of tunnel parameters, the plurality of sensor parameters, and the fire model; and, calculating the fire alarm time, the installation point of the linear heat sensor and the alarm limit values of the detection system such that a potential fire is quickly and reliably detected by the configured tunnel fire detection system.

2. The method for configuring the tunnel fire detection system according to claim 1, wherein the plurality of tunnel parameters comprise parameters describing the tunnel dimensions.

3. The method for configuring the tunnel fire detection system according to claim 1, wherein the plurality of tunnel parameters comprise parameters describing the wind conditions in the tunnel.

4. The method for configuring the tunnel fire detection system according to claim 1, wherein the plurality of linear heat sensor parameters comprise parameters describing physical properties of the linear heat sensor.

5. The method for configuring the tunnel fire detection system according to claim 1, wherein the plurality of linear heat sensor parameters comprise parameters describing the position of the linear heat sensor.

6. The method for configuring the tunnel fire detection system according to claim 1, wherein the plurality of linear heat sensor parameters comprise parameters describing the installation geometry of the linear heat sensor.

7. The method for configuring the tunnel fire detection system according to claim 1, wherein the fire model is based, at least in part, on parameter sets obtained from theoretical calculations.

8. The method for configuring the tunnel fire detection system according to claim 1, wherein the fire model is based, at least in part, on parameter sets obtained from practical experience.

9. The method for configuring the tunnel fire detection system according to claim 1, wherein the fire model comprises a model describing fire development in the reaction zone.

10. The method for configuring the tunnel fire detection system according to claim 1, wherein the fire model comprises a model describing behavior of the combustion gases in the cooling-down zone above the reaction zone.

11. The method for configuring the tunnel fire detection system according to claim 10, wherein the model describing the behavior of the combustion gases in the cooling down zone above the reaction zone, involves calculation of the behavior of the flow of hot combustion gases as a result of mixing with the ambient gas in a turbulent peripheral area.

12. The method for configuring the tunnel fire detection system according to claim 1, wherein the fire model comprises a model describing the calculation of the reaction enthalpy.

13. The method for configuring the tunnel fire detection system according to claim 1, wherein the fire model comprises a model describing the energy balance.

14. The method for configuring the tunnel fire detection system according to claim 1, wherein the fire model comprises a model describing the ascending force in the reaction zone.

15. The method for configuring the tunnel fire detection system according to claim 1, wherein the fire model comprises a model describing the fire development.

16. A method of configuring a fire detection system having a linear heat sensor, comprising:

providing a plurality of parameters describing the system installation location;

providing a plurality of sensor parameters describing the linear heat sensor;

providing a fire model describing aspects of fire development;

calculating the fire development based on the plurality of installation location parameters, the plurality of sensor parameters, and the fire model; and, calculating the fire alarm time, the installation point of the linear heat sensor, and the alarm limit values of the detection system, and the fire alarm time such that a potential fire is quickly and reliably detected by the configured fire detection system.

17. A system for configuring a tunnel fire detection system having a linear heat sensor, comprising:

a storage device for storing a plurality of parameters and a plurality of fire models;

said plurality of parameters, comprising:

a plurality of tunnel parameters describing the tunnel, and a plurality of sensor parameters describing the linear heat sensor, said plurality of fire models describing aspects of fire development;

an input device for entering data describing the plurality of parameters;

a processing unit for calculating the fire development and the resultant heating of the linear heat sensor on the basis of the plurality of parameters and the plurality of fire models to determine alarm limit values and fire alarm response tires for the configured fire detection system;

a display device for the output of alarm limit values and fire alarm times, which are obtained based upon the plurality of parameters and the plurality of fire models.

18. A portable computer for configuring a tunnel fire detection system comprising:

a storage device for storing a plurality of parameters;

said plurality of parameters, comprising:

a plurality of tunnel parameters describing the tunnel, and a plurality of sensor parameters describing the linear heat sensor, a CD-ROM Drive;

a CD-ROM in the CD-ROM drive for storing a plurality of fire models;

said plurality of fire models describing aspects of fire development;

an entry keyboard for entering data describing the plurality of parameters;

a processing unit for calculating the fire development and the resultant heating of the linear heat sensor on the basis of the plurality of parameters and the plurality of fire models to determine alarm limit values and fire alarm response times for the configured fire detection system;

a printer connection for the output of the determined alarm limit values and fire alarm response times which are obtained based upon the plurality of parameters and the plurality of fire models; and a display screen for displaying the determined alarm limit values and fire alarm response times for the configured fire detection system.

* * * * *

UNITED STATES PATENT AND TRADEMARK OFFICE

CERTIFICATE OF CORRECTION

PATENT NO. : 6,507,281 B2
DATED : January 14, 2003
INVENTOR(S) : Mägerle et al.

It is certified that error appears in the above-identified patent and that said Letters Patent is hereby corrected as shown below:

Title page,
Item [73], Assignee, "Siemens Aktiengesellschaft" should read -- Siemens Building Technologies AG, --; and "(DE)" should read -- Zurich (CH) --

Signed and Sealed this

Twenty-second Day of July, 2003

JAMES E. ROGAN
*Director of the United States Patent and Trademark Office*